United States Patent [19]

Thorne

[11] Patent Number: 4,606,167

[45] Date of Patent: Aug. 19, 1986

[54] FABRICATED ROUND INTERIOR COLUMN AND METHOD OF CONSTRUCTION

[76] Inventor: Parker Thorne, 2839 Sheridan Pl., Evanston, Ill. 60201

[21] Appl. No.: 666,657

[22] Filed: Oct. 31, 1984

[51] Int. Cl.[4] ..... E04C 3/30

[52] U.S. Cl. ..... 52/727; 52/725; 52/364; 52/746

[58] Field of Search ..... 52/725, 727, 728, 724, 52/261, 364, 712, 746

[56] References Cited

U.S. PATENT DOCUMENTS

| | | | |
|---|---|---|---|
| 4,023,374 | 5/1977 | Colbert et al. | 52/725 X |
| 4,467,584 | 8/1984 | Crites et al. | 52/727 |
| 4,484,427 | 11/1984 | Crites et al. | 52/727 X |

FOREIGN PATENT DOCUMENTS

| | | | |
|---|---|---|---|
| 2042034 | 9/1980 | United Kingdom | 52/725 |

OTHER PUBLICATIONS

"Save Steel Cut Costs", Architectural Forum, National Gypsum Company, Feb. 1952, p. 22.

*Primary Examiner*—Carl D. Friedman
*Assistant Examiner*—Naoko N. Slack
*Attorney, Agent, or Firm*—Hill, Van Santen, Steadman & Simpson

[57] ABSTRACT

Round columns for finishing the interior of a building in which fiber tube members are split and positioned to enclose structural supporting columns. The fiber tube members are secured to metal framing which are anchored in a spaced and coaxial positions relative to the structural supporting columns. A finish coating is applied to the surface of the fiber tube members to complete the construction which is relatively inexpensive, structurally strong and aesthetically pleasing to the eye.

11 Claims, 8 Drawing Figures

FABRICATED ROUND INTERIOR COLUMN AND METHOD OF CONSTRUCTION

BACKGROUND OF THE INVENTION

1. Field of the Invention

The present invention relates to finished interior columns of a building and more particularly to a round column with an applied trowel finish which encloses the structural steel support columns of the building.

2. Description of the Prior Art

When finishing and decorating the interior of a large building the structural steel columns are typically framed out with metal lath, metal corner beads and the like and then covered with several layers of plaster to enclose the unsightly steel structural columns. Frequently, building plans require that the interior columns be finish plastered in a round cylindrical configuration, which greatly complicates the finishing procedure. This requirement is both time consuming and difficult to achieve, often requiring considerable reworking before an acceptable round column shape is produced. This, of course, adds considerably to the construction costs and delays.

Building structural steel columns are usually spray coated with a fire proofing material which produces a relatively rough irregular surface to work with and further complicates the finishing of the structural columns.

Past attempts to overcome this problem included producing expensive half cylindrical sections which are molded of fiberglass or the like and positioned about the steel columns. The two half sections are then joined together by fasteners along vertically extending overlapping margins. The joints are thereafter filled with grouting material and sanded smooth. These fiberglass sections proved to be excessively flexible and dimensionally unstable. Further, when these sections are stored in a horizontal position for a length of time, they sag and will not retain a "true" round (half round) configuration. This resulted in an objectionable eliptical or egg shaped column. Thereafter, much corrective measures are required by the plasters to "true" the columns.

Accordingly, there is a need for a finished column construction which produces accurate and relatively inexpensive round interior columns.

SUMMARY OF THE INVENTION

The present invention provides a round interior column which is comparatively inexpensive to construct and which comprises an ideally finished interior column ready for decoarating. A pair of angle shape ring members are securely mounted to the floor and at the ceiling level about the structural steel support column of a building. The ring members are vertically aligned relative to one another and are spaced radially outward from the steel support column. A sheet metal stud is secured to the ring members and extends between the floor and ceiling. Stabilizing brackets are secured between the structural steel column and the stud to brace a mid portion of the stud.

A spiral wound fiber tube form, having an inside diameter generally equal to the outside diameter of the ring members and being split along its length is then forced open and positioned around the structural steel support column. The fiber tube is then allowed to spring back to its normal round configuration to seat about the floor mounted and ceiling mounted ring members. The split being aligned with the metal stud. Fasteners are thereafter used to secure the fiber tubular column to the ring members and the stud. The inherent internal elasticity of the fiber tube insures that the tube will return to its normal true round configuration.

Fiber tube forms of this general form have been used in the past as concrete forms and are available in a wide range of diameters and lengths. Further, where required by building codes, flame resistant materials may be utilized. These tubes are preferably supplied with an external moisture barrier and a dry wall joint taping operation is used to patch over the split line. A smooth finish coating is applied to the outer surface of the fiber tube to complete the columns which is then ready for decorating.

It is therefore an object of the present invention to provide an interior column which is constructed in a simple, inexpensive manner and which produces an aesthetically handsome and structurally strong finished column.

Another object of this invention is to provide a simple constructed interior column which is adapted to enclose a structural steel support column.

Yet another object of this invention is to provide a round interior column which is accurate and true in configuration.

Still another object of this invention is to provide a finished, round interior column which may enhance the flame resistance protection for the structural steel support columns.

Other objects and advantages of the present invention will be readily apparent from the following description of the preferred embodiment threof taken in conjunction with the accompanying drawings, although variations and modifications may be effected without departing from the spirit and scope of the novel concepts of the disclosure.

DESCRIPTION OF THE PREFERRED EMBODIMENT

Figure 1:
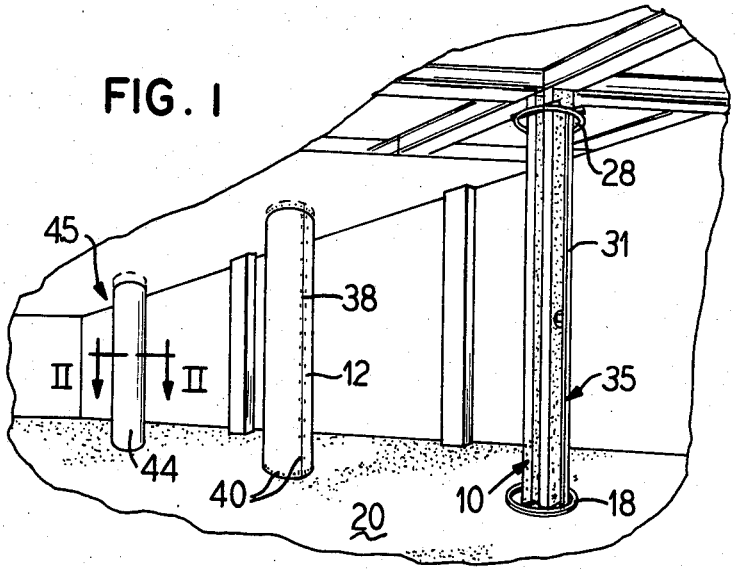
FIG. 1 is a perspective view of a building showing interior column construction in accordance with the principles of this invention at various stages of completion.

In FIG. 1 there is shown a structural steel, skeleton frame building having 'H' section interior steel support columns 10. Typically the steel columns 10 are spray coated with a thick fireproofing material 11 which leaves the column in a rather rough unsightly condition.

In finishing these columns so that they are aesthetically pleasing and ready for decorating a cylindrical tube form section 12 is provided to enclose each steel support column 10.

The tube section 12 comprises a fiber tube which may be of a type similar to tube form sections used as concrete forms. The tubes are manufactured of spiral wound fiber strip having a built-up wall thickness in the order of ¼" to ½" depending on the tube diameter, length and service conditions. The fiber tubes may also be treated or impregnated with a fire proofing material when desired. These spiral wound fiber tube sections possess a high degree of stability and retain an exacting round configuration even if the tube sections are stored in a horizontal position for an extended time.

Figure 3:
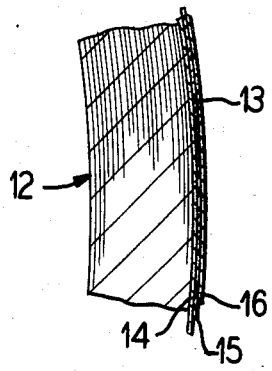
FIG. 3 is a greatly enlarged fragmentary sectional view of the fiber tube column.

As best seen in FIG. 3, the tube 12 is provided with a moisture barrier outer coating 13 comprising a sandwich of heavy kraft paper 14; polyethylene film 15 and an outer heavy kraft paper facing 16 which is secured to the outside of the fiber tube section with water resistant adhesive.

Figure 2:
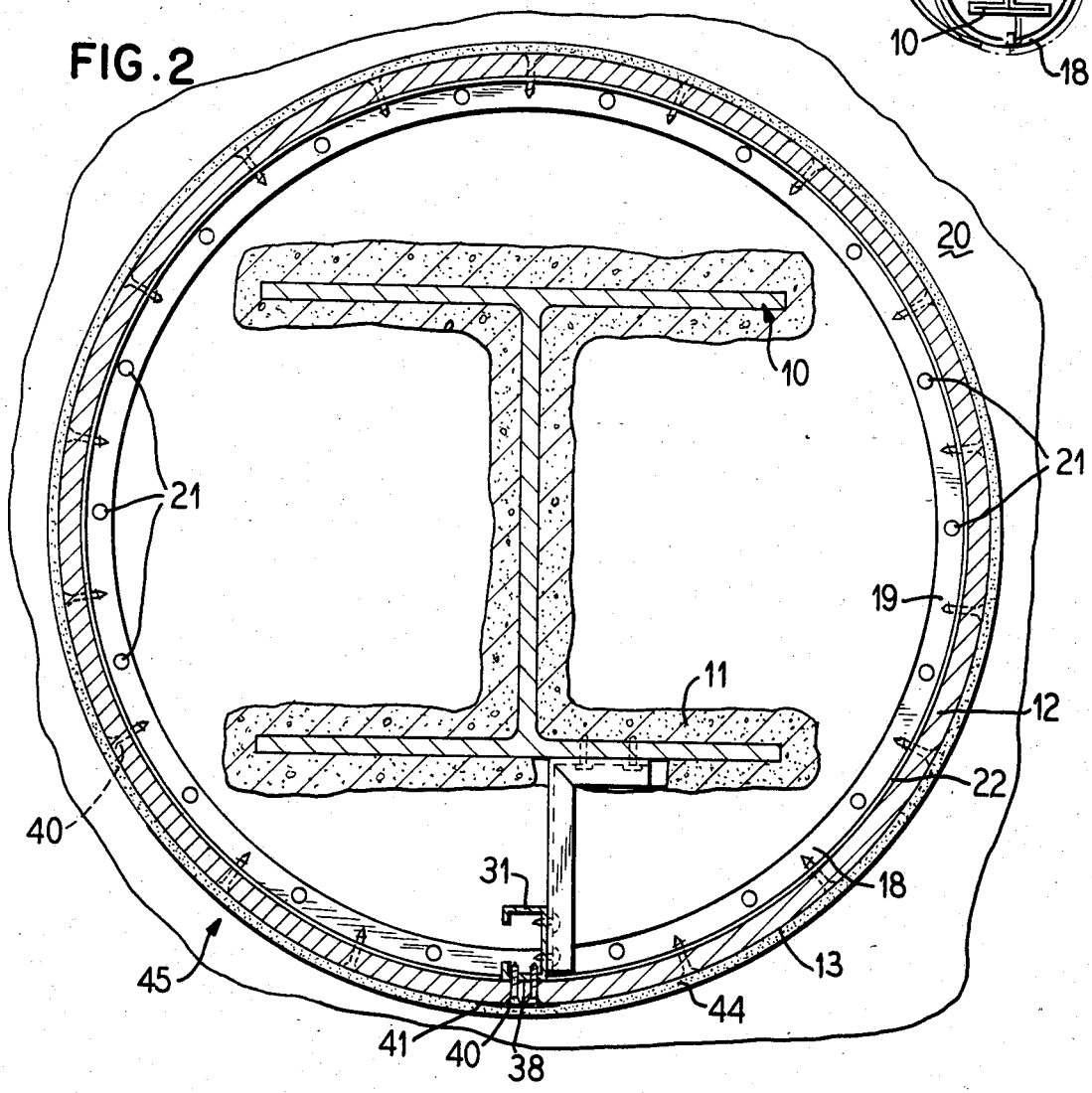
FIG. 2 is an enlarged transverse sectional view taken along the line II—II of FIG. 1.

A steel mounting ring 18 is rigidly secured to the concrete floor 20 of the building, coaxial with the steel support column 10 and radially spaced therefrom. As shown in FIG. 2 a horizontal leg 19 of the angle shaped mounting ring is anchored to the floor at closely spaced intervals by power driven fasteners 21 and an annular leg 22 extends upward to receive a complementary sized, lower end of the tube section 12.

Figure 5:
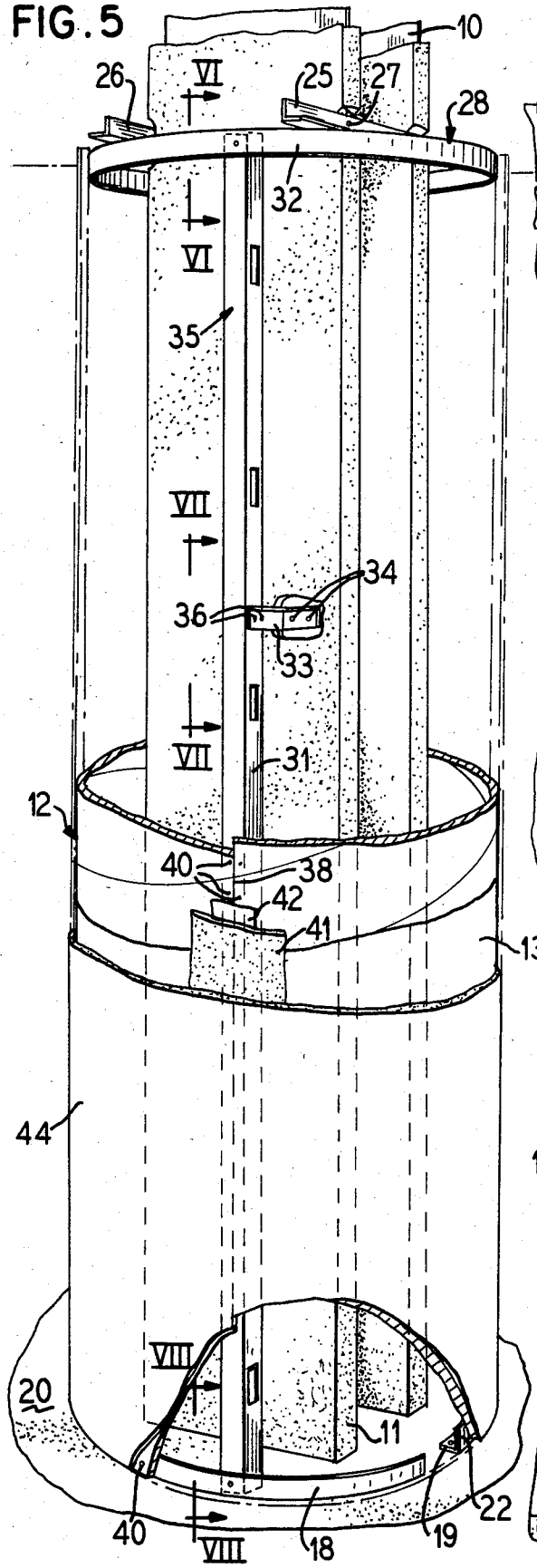
FIG. 5 is a perspective view of a round interior column with portions broken away to shown the construction of the column.
Figure 6:
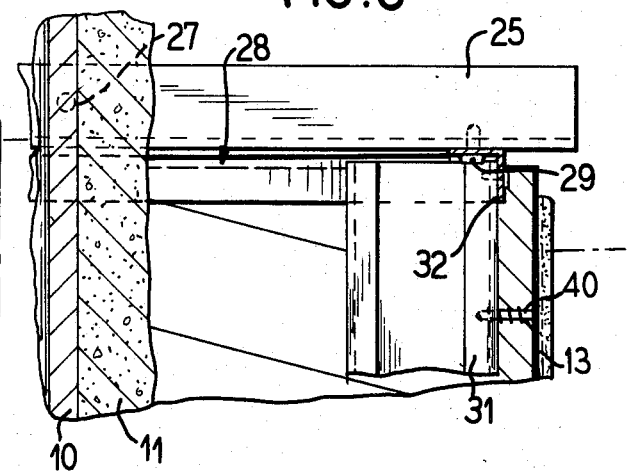
FIG. 6 is an enlarged vertical sectional view taken generally along the line VI—VI of FIG. 5.
Figure 7:
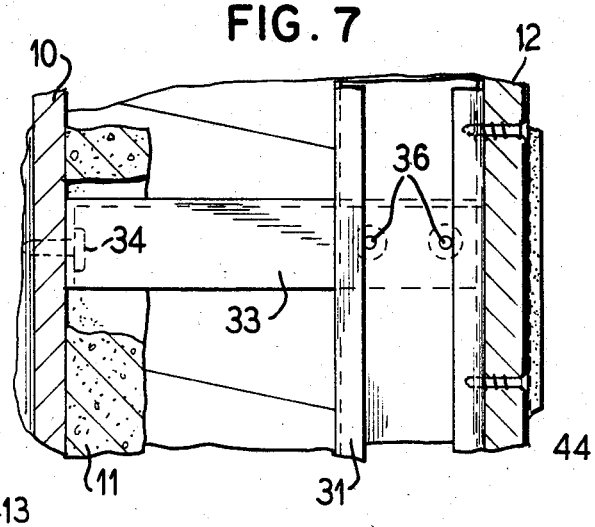
FIG. 7 is an enlarged vertical sectional view taken generally along the line VII—VII of FIG. 5.
Figure 8:
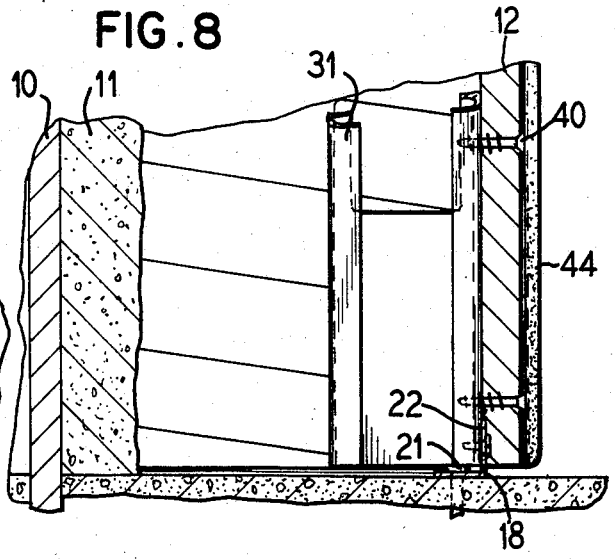
FIG. 8 is an enlarged vertical sectional view taken generally along the line VIII—VIII of FIG. 5.

As best seen in FIGS. 5 and 6 a pair of angle members 25, 26 are secured to the structural steel column 10, adjacent to the ceiling level to support a second steel mounting ring 28. It will be seen in FIG. 5 that portions of the fire proofing material 11 is removed to expose smooth attachment surfaces of the steel column 10. The angle members are also preferably attached to the steel column by power drive fasteners 27 and screw fasteners 29 in turn attach the mounting ring 28 to the angle members 25 and 26.

A sheet metal stud 31 is connected between a downward extending annular leg 32 of the mounting ring 28 and the upward extending annular leg 22 of the mounting ring 18 to provide a floor to ceiling mounting support for the cylindrical fiber tube section 12. Stabilizing brackets 33 are provided to brace the metal stud 31 and are attached to a bare surface of the steel column 10 by any suitable means such as power driven fasteners 34 or the like. The bracket 33 may be secured to the metal stud with self tapping sheet metal screws 36. Additional brackets 33 may be used if desired to provide greater stability. Thus, a stable rigid steel mounting frame 35 is provided for supporting and securing the cylindrical fiber tube section 12. With large diameter fiber tubes or for greater internal bracing two more metal studs can be utilized.

Figure 4:
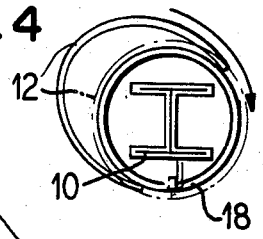
FIG. 4 is a diagrammatic sectional view showing the fiber tube column split and being installed about an interior structural steel support column.

Now with specific reference to FIG. 4 the tube section 12 is shown to be slit vertically along its full length and is sprung open a sufficient amount to pass around the steel support column 10 and then allowed to close and seat around the mounting rings 18 and 28 with the slit edges closed together and aligned with the metal stud 31. Since the cylindrical fiber tube section 12 is inherently resilient it will spring back to its normal round configuration. The tube section 12 thereupon is mounted to the steel mounting frame 35 as with screws 40 which may be of the bugle head drywall type. As best seen in FIGS. 1 and 2 of the drawings, the lower end of the fiber tube section 12 is secured to the vertical leg 22 of the mounting ring 18 and the upper end of the tube section is secured to the annular leg 32 of the mounting ring 28. Further, a series of screws 40 secure the cylindrical tube section 12 to the metal stud 31 along each of the adjoining edges adjacent the slit line 38.

The screws 40 are closely spaced and turned down tight as is typically done in dry wall construction. Thereafter, a finishing patch 41 is applied over the slit 38. Typically, a thin layer of taping compound is layed down along the slit 38 and a paper tape 42 pressed onto the wet compound. A thin top smooth layer is then applied over the tape to finish the patch 41. Herein the tape 42 bridges over the slit line 38 to prevent cracks from developing along the slit when the finishing coating 44 is applied to the entire surface of the cylindrical fiber tube section 12. The finishing coating 44 can be of any suitable thickness, normally in the order of 1/16" to ⅛" and is applied directly over the moisture barrier outer coating 13 of the tube section and of course over the patch 41.

Thus it can be seen that the accurate round configuration of the fiber tube section 12 provides an excellent base to apply a finish coating which is aesthetically pleasing to the eye and simple to construct. After the finish coat is dry, sanding and decorating complete the interior column 45. A floor covering and/or base molding will cover over any gap or space between the floor 20 and the bottom edge of the tube 12 and a dropped ceiling will obscure the angle members 25 and 26 and any irregularities at the upper end of the fiber tube section 12.

As is apparent from the foregoing specification, my invention is susceptible of being embodied with various alterations and modifications which may differ somewhat from what has been described in the preceding specification.

It should be understood that I wish to embody within the scope of the patent warranted hereon all such modifications as reasonably and properly come within the scope of my contribution to the art.

I claim:

1. A round interior column structure comprising:

a round fiber tube means having an exterior surface with a true round configuration and being adapted to enclose a structural supporting column of a building, said fiber tube means being split along its length to form opposed split edges, said fiber tube means being inherently resilient to urge said opposed split edges together;

a mounting frame means arranged to support said fiber tube means in a co-axial, rigid orientation relative to said structural supporting column;

fastening means for attaching said fiber tube means to said mounting frame means; and a troweled on coating applied to said exterior surface to aesthetically finish said round interior column structure.

2. The round interior column structure of claim 1, wherein said exterior surface comprises a moisture proof barrier.

3. The round interior column structure of claim 1, wherein said mounting frame means includes a pair of spaced circular mounting rings of substantially the same diameter as said fiber tube and a stud means extending vertically between said spaced mounting rings, an upper and a lower annular edge of said fiber tube means fastened over respective ones of said pair of spaced mounting rings, and tube means portions adjacent said split edges being fastened to said stud means.

4. A round interior column structure for enclosing a structural support column between the floor and ceiling of a building comprising:

a pair of mounting rings, a first of said pair of mounting rings being anchored to the floor of a building coaxially with a structural support column and a second of said mounting rings being mounted adjacent said ceiling in vertical alignment with said first mounting ring;

a stud means having opposite ends thereof connected to said pair of mounting rings and extending between said floor and said ceiling;

a spiral wound fiber tube means having a water Proof external surface and having a slit extending along the full length thereof defining opposed slit edges, said fiber tube means being inherently resilient to cause said fiber tube means to return to a true round configuration with said slit edges substantially closed when said slit edges are forced open to accommodate said structural support column, said fiber tube means being seated on said pair of mounting rings with said slit aligned with and abutting said stud means, fastening means anchoring said fiber tube means to said pair of mounting rings and to said stud means, and a finish coating applied to the entire water proof external surface of said fiber tube means.

5. The round interior column structure according to claim 4, wherein said slit is patched with a dry wall tape.

6. The round interior column structure according to claim 4, wherein said second mounting ring is carried by a pair of angle members mounted to said structural support column adjacent said ceiling.

7. A structure as claimed in claim 4, wherein said spiral wound round fiber tube is of heavy kraft paper and plastic film.

8. A structure as claimed in claim 4, further comprising a bracket extending between said structural support column and an intermediate location along said stud means.

9. A round interior column structure for enclosing a structural column of a building comprising:

first and second mounting rings mounted at spaced locations coaxial with said structural column, said first and second mounting rings each having an annular mounting surface of substantially equal diameter;

a stud extending between said first and second mounting rings at respective ones of said annular mounting surfaces;

at least one bracket fastened to said structural column and connected to said stud;

a tube having a diameter substantially equal to said mounting surface diameter and having a split along its length defining opposed split edges, said tube being inherently resilient to cause said opposed split edges to remain normally substantially closed, first and second opposite ends of said tube being fastened to respective ones of said mounting ring mounting surfaces, said opposed split edges being fastened to said stud, means for concealing said split, and a finish coating over an external surface of said tube.

10. A method of aesthetically finishing an interior structural column of a building, comprising the steps of:

attaching a first mounting ring to the floor of a building, coaxial with a steel structural supporting column;

attaching a second mounting ring adjacent to the ceiling of a building, coaxial with said steel structural supporting column and in vertical alignment with said first mounting ring;

connecting a stud means to said first and second mounting rings to extend vertically therebetween;

selecting a fiber tube section with a diameter and a length to enclose said steel structural supporting column and to seat on said mounting rings;

applying a moisture proof barrier to an external surface of said fiber tube section;

slitting said fiber tube section along its full length;

opening said slit and positioning said fiber tube section to enclose said steel structural supporting column and with said slit aligned with said stud means;

attaching said fiber tube section to said first and second mounting rings;

attaching said fiber tube section to said stud means along said split; and applying a finishing coat of plaster over said water proof barrier of said fiber tube section.

11. The method of aesthetically finishing an interior structural column according to claim 8, including the additional step of applying a patch over said split.

* * * * *